US006155736A

United States Patent [19]

Evans et al.

[11] Patent Number: 6,155,736

[45] Date of Patent: Dec. 5, 2000

[54] DEVICE FOR DISPENSING PARTICULATE MATERIAL

[75] Inventors: Jonathan Taylor Evans; Barbara Reid Evans, both of Santa Barbara, Calif.

[73] Assignee: Evans Enterprises, Santa Barbara, Calif.

[21] Appl. No.: 09/430,852

[22] Filed: Oct. 29, 1999

Related U.S. Application Data

[62] Division of application No. 09/165,179, Oct. 1, 1998, Pat. No. 6,042,289.

[51] Int. Cl.[7] ..... B43M 11/02

[52] U.S. Cl. ..... 401/219; 401/209; 401/216

[58] Field of Search ..... 401/208, 209, 401/215, 216, 219, 220, 175

[56] References Cited

U.S. PATENT DOCUMENTS

| | | | |
|---|---|---|---|
| 635,592 | 10/1899 | Rauhoff | 401/208 |
| 1,776,981 | 9/1930 | Rae | 401/208 |
| 2,284,218 | 5/1942 | Livingston | 401/175 |
| 3,075,230 | 1/1963 | Marchant | 401/208 |
| 3,111,703 | 11/1963 | Kaufman | 401/208 |
| 4,150,904 | 4/1979 | Stewart | 401/186 |
| 4,342,522 | 8/1982 | Mackles | 401/214 |
| 4,723,860 | 2/1988 | Giblin et al. | 401/208 |
| 4,752,148 | 6/1988 | Mann | 401/208 |
| 5,007,754 | 4/1991 | Zierhut | 401/174 |
| 5,213,431 | 5/1993 | Gentile et al. | 401/219 |
| 5,753,212 | 5/1998 | Pescatore et al. | 401/175 |
| 5,839,622 | 11/1998 | Bicknell et al. | 401/175 |

FOREIGN PATENT DOCUMENTS

| | | | |
|---|---|---|---|
| 962771 | 6/1951 | France | 401/208 |

*Primary Examiner*—David J. Walczak
*Attorney, Agent, or Firm*—Jeffer, Mangels, Butler & Marmaro LLP

[57] ABSTRACT

A device for dispensing particulate material includes a dispenser housing having an interior divided into an upper portion and a lower portion, a roller member rotatably mounted at least partially within the upper portion of the dispenser housing interior and structure for supporting the particulate material spaced below the roller member.

7 Claims, 4 Drawing Sheets

DEVICE FOR DISPENSING PARTICULATE MATERIAL

This is a divisional of application Ser. No. 09/165,179 filed on Oct. 1, 1998 now U.S. Pat. No. 6,042,289.

FIELD OF THE INVENTION

The present invention relates to a dispensing device for applying particulate materials to a surface.

BACKGROUND OF THE INVENTION

Prior devices for dispensing particulate materials have included such devices as canisters with apertures in the top surface, containers with rotating applicators disposed in a top opening and applicators that are dipped in the particulate substance and then applied to the surface. For example, U.S. Pat. No. 853,405 to Godward discloses a dispenser for applying tooth powder onto a toothbrush. The dispenser is a device that is used with a conventional powder container. The applicator comprises a rolling cage having a perforated periphery that is located between the endwalls of the container. In operation, when the container is inverted powder will fall through the perforations in the cage. The cage is placed against an object, such as a toothbrush, and rotated, thereby dispensing the powder through the perforations and onto the toothbrush. This invention may work well for tooth powder, but larger grain particulates present delivery difficulties. Also, this device requires attachment to a canister already containing powder and inversion of the device for it to work.

Other dispensers comprising rolling applicators are known in the art. However, many of these are for applying liquid substances. U.S. Pat. Nos. 4,555,196 to De Garmo and 4,128,350 to Gamache are examples of liquid applicators. These devices also must be attached to a container already holding a substance. Furthermore, these devices would become clogged if they were used with relatively large size particulate materials.

Another disadvantage of prior art dispensers is that they have to be used in an inverted position because gravity is used to hold the material to be dispensed against the applicator.

A need exists for a roll-on applicator for dispensing particulate materials which is self-contained, provides a wide coverage area per stroke, can accommodate different-sized particulates, can be used in a non-inverted position and overcomes the other disadvantages associated with the prior art.

SUMMARY OF THE PREFERRED EMBODIMENTS

An improved applicator for dispensing particulate materials such as powders, beads, microgranules and the like is provided. In accordance with one aspect of the present invention, there is provided a device for dispensing particulate material that includes a dispenser housing having an interior divided into an upper portion and a lower portion, a roller member rotatably mounted at least partially within the upper portion of the dispenser housing interior and means for supporting the particulate material spaced below the roller member.

In a preferred embodiment of the present invention, the means for supporting the particulate material is a top receptacle portion, which has first and second major surfaces and divides the dispenser housing interior into the upper and lower portions and has at least one edge spaced from the dispenser housing. A dispensing slot, which communicates the upper and lower portions of the dispenser housing interior, is defined between the dispenser housing and the at least one edge of the top receptacle portion.

In another preferred embodiment of the present invention, the means for supporting the particulate material is a movable member which is in mechanical communication with an engagement portion. The movable member is disposed within the dispenser housing interior and partially encloses a variable volume pump chamber along with the dispenser housing and the roller member.

In yet another preferred embodiment of the present invention, the means for supporting the particulate material is a cup portion. The dispenser housing has an annular portion that defines an opening. The cup has a top and bottom surface and is supported below the opening in the annular portion. More than one-half of the roller member is located below the annular portion and a portion of the roller member protrudes through the opening and above the annular portion.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
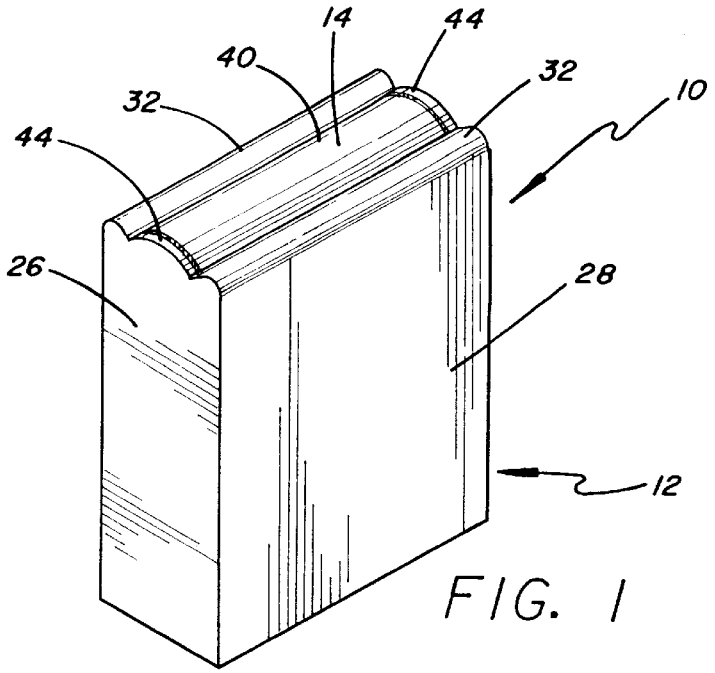
FIG. 1 is a perspective view showing a dispenser housing and roller member in accordance with a first embodiment of the present invention.
Figure 2:
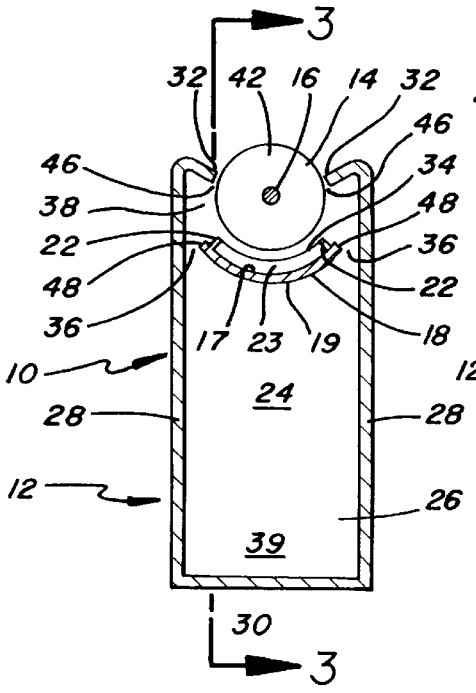
FIG. 2 is a sectional side view of the dispenser housing and roller member of FIG. 1 including a top receptacle portion.
Figure 3:
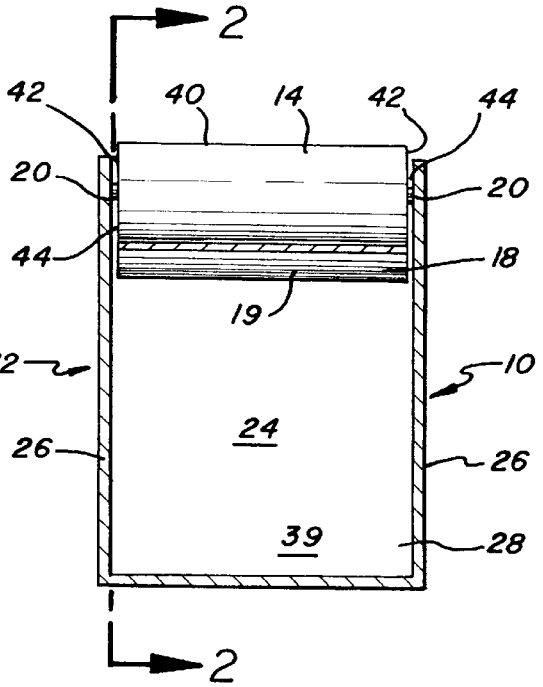
FIG. 3 is a sectional front view of the dispenser housing and roller member including the top receptacle portion of FIG. 2.

Referring to FIGS. 1–3, a first embodiment of a device 10 for dispensing particulate material includes a dispenser housing 12 having defined therein a dispenser housing interior 24. The dispenser housing interior 24 has an upper portion 38 and a lower portion 39, and is adapted to receive a particulate material (not shown). The dispenser housing 12 has endwalls 26, sidewalls 28, and a bottom 30. A curved lip 32 extends inward from each endwall 28. The dispenser housing 12 as illustrated is preferably rectangular in shape. However, it will be understood that any geometric shape for the dispenser housing 12 is within the scope of the present invention and the shape of the dispenser housing is not a limitation thereon.

Preferably, the bottom 30 is removable from the remainder of the dispenser housing 12. Other similar means known to those skilled in the art for securing a bottom or cover on or to a canister, housing or the like is within the scope of the present invention. For example, the bottom 30 can be slidably engaged with opposing slots in the dispenser housing 12; the bottom 30 can be pivotally hinged to the dispenser housing; or the bottom 30 can have a lip around the perimeter that securedly engages the dispenser housing 12. Alternatively, the bottom 30 can be sealed to the walls of the dispenser housing 12.

The elements of the dispenser housing 12 (the endwalls 26, the sidewalls 28 including the lips 32, and the bottom 30) preferably are comprised of a plastic, such as nylon or a phenolic resin, or a metal such as aluminum or stainless steel. The material of the dispenser housing 12 can be rigid or pliable. Also, the dispenser housing 12 can be formed as one continuous piece, or two or more separate elements can be attached to one another by a conventional attachment method such as gluing, welding or the like.

Extending between and attached to each endwall 26 are means for supporting the particulate material or top receptacle portion 18, preferably arcuately shaped, having a first major surface 17 opposite a second major surface 19. The top receptacle portion 18 also has opposing edges 48, at least one of which is in spaced relation to a sidewall 28 of the dispenser housing 12, thereby defining at least one dispensing slot 36 therebetween that communicates the lower portion 39 of the dispenser housing interior 24 with the upper portion 38 of the dispenser housing interior 24.

The lips 32 and the tops of the endwalls 26 define an opening therebetween, in which is rotatably mounted at least one cylindrically shaped roller member 14 having a contact surface 40 and opposite ends 42 and being spaced above the top receptacle portion 18. In a preferred embodiment of the invention, the contact surface 40 has a textured or roughened surface that is advantageous in collecting particulate material thereon. For example, the contact surface 40 can be comprised of or can be covered with a soft fluffy or plush material, such as cotton, soft cloth, velvet, felt, latex rubber or the like. Soft materials such as these are advantageous for covering the contours when rolling the contact surface 40 over an uneven surface. They are also advantageous for use on human skin. Alternatively, the contact surface 40 can include an adhesive material or can be advantageously statically charged to attract the particulate material.

Mounting members 16 are rigidly attached via a conventional method at the center of the opposite ends 42 of the roller member 14, such that the mounting members 16 extend axially therefrom. Alternatively, the mounting members 16 and the roller member 14 form a single unit. Receptacles 20 adapted to receive the mounting members 16 are defined in the endwalls 26 as shown in FIG. 3, such that when the mounting members 16 are received by the receptacles 20, the mounting members 16 are free to rotate within the receptacles 20. The device 10 can include any number of mounting members 16 and/or receptacles 20.

Figure 4:
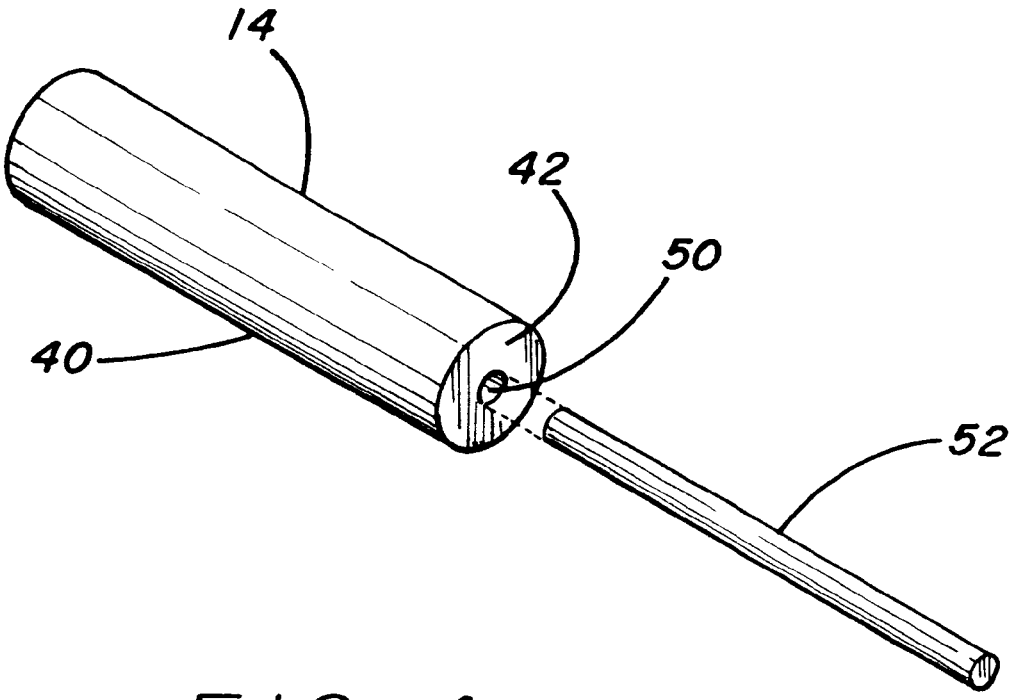
FIG. 4 is an exploded perspective of the roller member and rod in accordance with an embodiment of the present invention.

Alternatively, as shown in FIG. 4, the roller member 14 has a passage 50 adapted to receive a rod 52 running axially therethrough. In this embodiment, the opposite ends of the rod 52 are received by the receptacles 20 for mounting the roller member 14.

A seal member 44, preferably made of a soft and/or pliable material such as rubber or felt, is disposed between the end portions 42 of the roller member 14 and the endwalls 26 to prevent particulate material from escaping. Alternatively, a seal member(s) can be disposed on the inner edge of the lips 32, adjacent the contact surface 40.

The roller member 14 is oriented such that the contact surface 40 thereof isspaced from the top receptacle portion 18, thereby defining a reservoir 34 between the contact surface 40 and the top receptacle portion 18. The contact surface 40 is also in spaced relation to the outer edges of the lips 32, thereby defining dispensing areas 46 therebetween. The roller member 14 is preferably spaced close to the lips 32 to prevent excess particulate material from escaping through the dispensing areas 46.

One or more baffles 22 are preferably attached to the first major surface 17 of the top receptacle portion 18 to aid in holding particulate material in the reservoir 34 during operation of the present invention. Preferably, the baffles 22 are located at the edges of the first major surface 17 of the top receptacle portion 18, adjacent the dispensing slot(s) 36, to maximize the amount of particulate material that can be held in the reservoir 34. Preferably, a baffle 23 is also attached to the first major surface 17 perpendicular to baffles 22 to keep the particulate material from all sliding to one side when the device 10 is tipped. Alternatively, the baffles 22 (and optionally) 23 can be an integral part of the top receptacle portion 18. It will be understood that any advantageous configuration of baffles is within the scope of the present invention.

In operation, the device for dispensing particulate material 10 is preferably stored upside down to allow particulate material to settle in the upper portion 38 of the dispenser housing interior 24. When in use, the device for dispensing particulate material 10 is turned right-side up and a portion of the particulate material settles to the lower portion 39 of the dispenser housing interior 24 through the dispensing slots 36, while the rest of the particulate material remains in the reservoir 34. A portion of the particulate material in the reservoir 34 that is in contact with the contact surface 40 of the roller member 14 adheres to the contact surface 40. Alternatively, the device 10 can be stored right side up, then, when ready for use, can be tipped upside down to allow the particulate material to settle in the upper portion 38 as described above.

The contact surface 40 is then placed in contact with a surface to be coated, for example, a portion of the human body. Device 10 is then moved in a direction substantially perpendicular to the axis of the roller member 40. The friction between the roller member 40 and the surface to be coated causes the roller member 40 to rotate about its axis, thus dispensing particulate material onto the surface to be coated.

Figure 5:
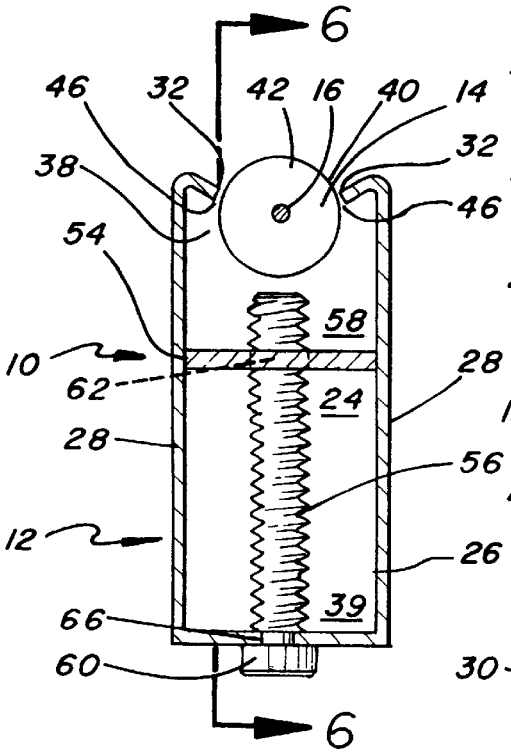
FIG. 5 is a sectional side view of the dispenser housing and roller member of a variation of the embodiment of FIG. 1 further including a movable member and elongated threaded member.
Figure 6:
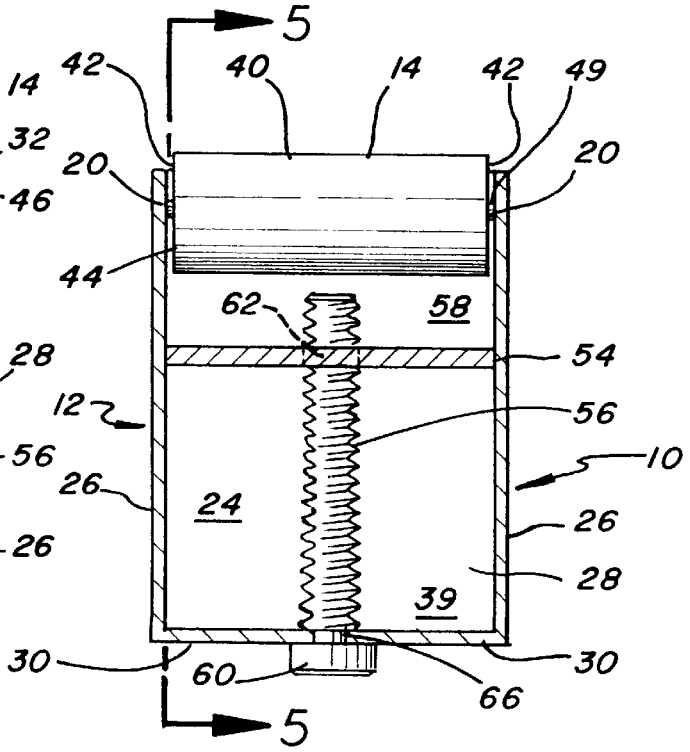
FIG. 6 is a sectional front view of the dispenser housing and roller member including the movable member and elongated threaded member of FIG. 5.

In another preferred embodiment, shown in FIGS. 5 and 6, the means for supporting the particulate material is a movable member 54 that is spaced below the roller member 14, is disposed within the dispenser housing interior 24 and is engaged by an engagement portion. In a preferred embodiment of the invention, the engagement portion is an elongated threaded member 56 terminating in a handle 60 at its bottom end. The movable member 54, the contact surface 40, the sidewalls 28 and the endwalls 26 all substantially enclose a variable volume particulate chamber 58, as shown in FIGS. 5 and 6. In a preferred embodiment, the elongated threaded member 56 threadedly engages a threaded hole 62 defined in the movable member 54. An opening 66, through which the elongated threaded member extends, is defined in the bottom 30 of the dispenser housing 12. The handle 60 is preferably removably attached to the elongated threaded member 56 on the end that extends outside of the opening 66 in the bottom 30. Alternatively, a securing member (not shown) can be disposed in the dispenser housing interior 24 to secure the top end of the elongated threaded member 56.

In operation, particulate material is disposed in the variable volume particulate chamber 58. The handle 60 is turned manually, thereby rotating the elongated threaded member 56 and causing the movable member 54 to move in an upward direction as a result of the threaded engagement of the hole 62 in the movable member 54 and the elongated threaded member 56. This movement reduces the size of the variable volume particulate chamber 58 and causes some of the particulate material within the variable volume particulate chamber 58 to be forced up and into contact with the contact surface 40 of the roller member 14. Other similar means known to those skilled in the art that will result in upward motion of the movable member 54 are within the scope of the present invention.

The contact surface 40 is then placed in contact with a surface to be coated and particulate material is dispensed as described above. As the device 10 is operated, the amount of particulate material in the variable volume particulate chamber 58 is reduced. When no more particulate material is in contact with the contact surface 40 of the roller member 14, the handle 60 is again turned, thus causing the movable member 54 to move in an upward direction, as described above, thereby reducing the size of the variable volume particulate chamber 58, and bringing additional particulate material into contact with the contact surface 40. This process is repeated as often as desired or until the variable volume particulate chamber 58 is empty.

Figure 7:
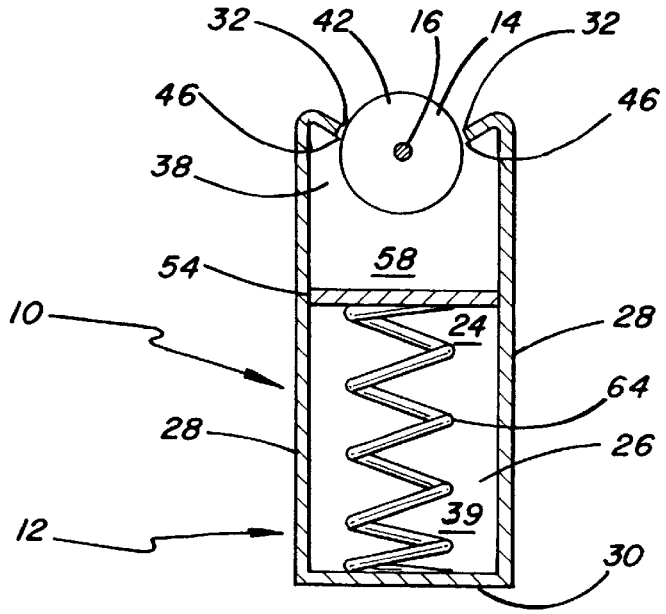
FIG. 7 is a sectional side view of the dispenser housing and roller member of a variation of the embodiment of FIG. 1 further including a spring member.

In another preferred embodiment, shown in FIG. 7, the engagement portion is a spring member 64 that is disposed in the lower portion 39 of the dispenser housing interior 24, such that the spring member 64 extends between the top surface of the bottom 30 of the dispenser housing 12 and the bottom surface of the movable member 54.

In operation, the spring member 64 maintains a force on the bottom surface of the movable member 54, thereby maintaining substantially constant contact between the particulate material remaining in the variable volume particulate chamber 58 and the contact surface 40 of the roller member 14 during operation. Particulate material is dispensed as described above. Other elements that maintain a force on the bottom surface of the movable member 54 or means for moving the movable member 54 can also be employed. For example, in an alternative embodiment, the means for moving the movable member 54 can be a pressure differential between the lower portion 39 of the dispenser housing interior 24 and the variable volume particulate chamber 58. In this embodiment, the higher pressure in the lower portion 39 of the dispenser housing interior 24 continually forces the movable member 24 against the particulate material in the variable volume particulate chamber 58.

Figure 8:
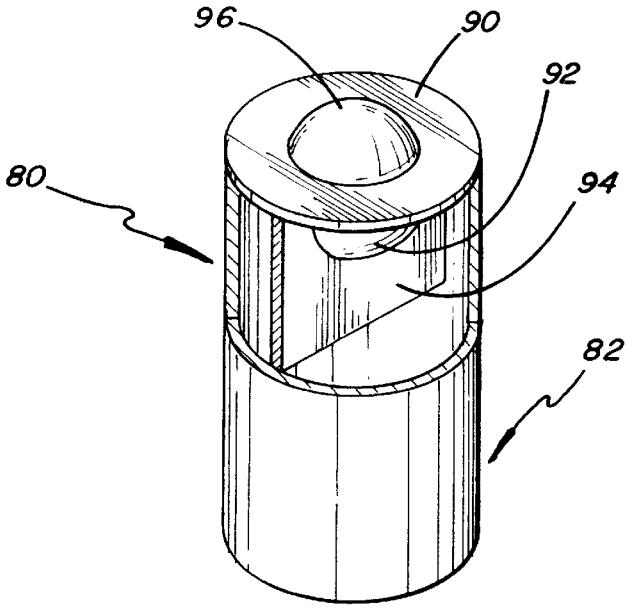
FIG. 8 is a sectional perspective of a dispenser housing and roller member in accordance with a second embodiment of the present invention.
Figure 9:
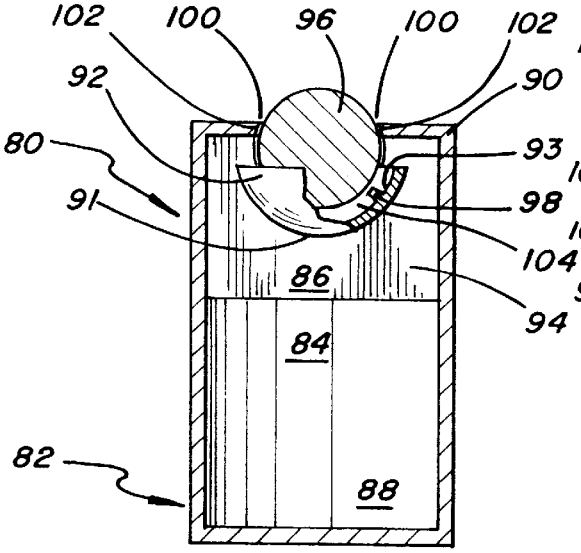
FIG. 9 is a sectional side view of the dispenser housing and spherical roller member of FIG. 8.

In another embodiment, shown in FIG. 8, a device for dispensing particulate material 80 includes a dispenser housing 82 surrounding a dispenser housing interior 84 having an upper portion 86 and a lower portion 88. The dispenser housing interior 84 is adapted to receive a particulate material (not shown), and is preferably ellipsoidal. However, other shapes for the dispenser housing 82 are within the scope of the present invention. The top of the dispenser housing 82 includes an annular portion 90. Located below the annular portion 90 is the means for supporting the particulate material, which, in this embodiment, is a cup member 92 having a bottom surface 91 and a top surface 93. The cup member 92, which preferably includes one or more baffles 98 attached to its top surface 93, is supported below the annular portion 90 by a support member 94. The support member 94 is preferably a thin sheet or the like that extends from the annular portion 90 and into the dispenser housing interior 84. However, other support members can also be employed to support the cup member 92 below the annular portion 90.

A roller member 96 is disposed in the opening of the annular portion 90, such that the roller member 96 is in radially spaced relation with the top surface 93 of the cup member 92, thereby defining a reservoir 104 therebetween. Preferably, more than one-half of the roller member 96 is located below the annular portion 90. The remainder of the roller member 96 protrudes outside the dispenser housing 80 for contact with a surface to be coated, thereby defining a dispensing area 100 between the roller member 96 and the inner edge 102 of the annular portion 90. This disposition of the roller member 96 retains the roller member 96 substantially in place, and allows the roller member 96 to float and to rotate when in operation. In a preferred embodiment of the invention, the roller member 96 has a textured, rough or soft surface, as described above. Also, a seal member (not shown) can be connected to the inner edge 102 of the annular portion 90 thereby preventing particulate material from escaping.

In operation, a particulate material is disposed in the dispenser housing interior 84 and the device 80 is stored in an inverted position, thereby allowing particulate material to fill the volume of the upper portion 86 of the dispenser housing interior 84. The device 80 can also be stored right side up as described above. When in use, the device 80 is turned right-side up, thus allowing some of the particulate material to settle on the top surface 93 of the cup portion 92 and come into contact with theroller member 96. The roller member 96 is placed in contact with a surface to be coated, and the device 80 is moved in a direction parallel to the surface to be coated. The friction between the roller member 96 and the surface to be coated causes the roller member 96 to rotate, thus dispensing particulate material onto the surface to be coated.

Figure 10:
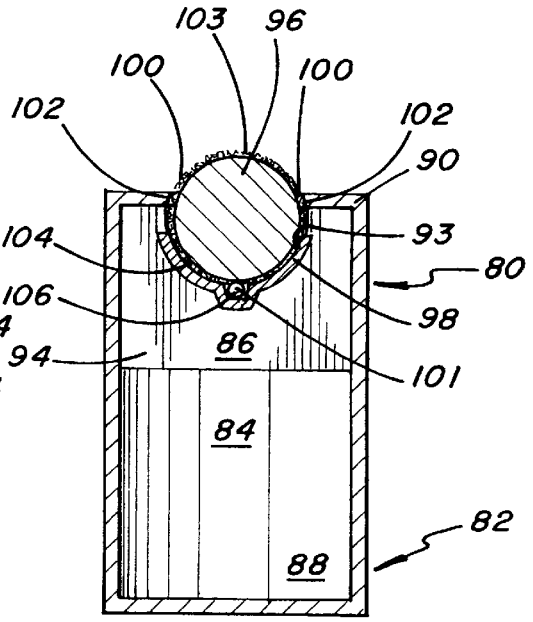
FIG. 10 is a sectional side view of the dispenser housing and roller member including a ball bearing in accordance with an alternative embodiment of the present invention.

Referring to FIG. 10, in an alternative embodiment, at least one ball bearing 101 or the like can be provided to aid in the rotation of the roller member 96. The ball bearing 101 is preferably used when the roller member has a soft or fluffy material 102 disposed thereon. Often, the coefficient of friction between the soft material 102 and the cup member 92 is greater than the coefficient of friction between the soft material 102 and the surface to be coated, thereby, in operation, not permitting the roller member 96 to rotate. In this embodiment, the device 80 includes a modified cup member 104 that defines an opening 106 adapted to receive the ball bearing 101, whereby the ball bearing 101 is contained in, yet can rotate within the opening 106. The ball bearing 101 is positioned such that its outer surface engages the soft material 102. Any number of ball bearings 101 can be employed.

It should be understood that it is within the scope of the present invention to use any shaped roller member 96 that can be advantageously used to dispense particulate material. For example, the roller member 96 can be cylindrical or ellipsoidal. It should further be understood that for any given embodiment of the invention the annular portion 90 defines a hole that is shaped to conform to the shape of the roller member 96. For example, if the roller member 96 is spherical, the annular portion 90 defines a circular hole; if the roller member 96 is ellipsoidal, the annular portion 90 defines an elliptical hole.

The embodiments of the present invention recited herein are intended to be merely exemplary and those skilled in the art will be able to make numerous modifications to them without departing from the spirit of the present invention. All such modifications are intended to be within the scope of the present invention as defined by the claims appended hereto.

What is claimed is:

1. A device for dispensing particulate material comprising:

(a) a dispenser housing having an interior, said interior having an upper and a lower portion, (b) a roller member rotatably mounted at least partially within said upper portion of said dispenser housing interior and defining a dispensing surface, and (c) a top receptacle portion having opposing first and second major surfaces disposed within said dispenser housing interior below said roller member, said top receptacle portion dividing said dispenser housing interior into said upper portion and said lower portion, said top receptacle portion having at least one peripheral edge, at least a portion of said peripheral edge being spaced from said dispenser housing thus defining at least one dispensing slot therebetween, by which said lower portion of said dispenser housing interior communicates with said upper portion of said dispenser housing interior to feed said particulate material into said top receptacle portion when said device is in an inverted position and where it remains when said device is turned from the inverted to an upright position.

2. The device of claim 1 wherein said dispensing surface is comprised of a soft material that covers said roller member.

3. The device of claim 1 wherein said dispenser housing comprises an annular portion defining an opening therein, wherein said top receptacle portion comprises a cup portion having a top surface and a bottom surface, said cup portion being supported below said opening in said annular portion, and wherein more than one-half of said roller member is located below said annular portion and a portion of said roller member protrudes through said opening and above said annular portion.

4. The device of claim 3 wherein said top surface of said cup portion has at least one baffle connected thereto.

5. The device of claim 3 wherein said dispensing surface is comprised of a soft material that covers said roller member.

6. The device of claim 3 wherein said cup portion defines at least one opening adapted to receive a ball bearing, and wherein a ball bearing is disposed in said at least one opening.

7. A method of dispensing particulate material, said method comprising the steps of:

(a) providing a rotatable member at least partially disposed in a housing, (b) providing a top receptacle portion spaced below said rotatable member, wherein said top receptacle portion has at least one peripheral edge spaced from said housing, thereby defining at least one dispensing slot formed between said peripheral edge and said housing, (c) at least partially inverting said housing thereby causing particulate matter to move through said at least one dispensing slot, (d) reinverting said housing, whereby at least a portion of said particulate material settles on said top receptacle portion, and (e) rotating said rotatable member, thereby dispensing the particulate material to a location outside of said housing.

* * * * *